US005882267A

United States Patent [19]

Roe

[11] Patent Number: 5,882,267

[45] Date of Patent: Mar. 16, 1999

[54] GOLF PUTTING TRAINER

[76] Inventor: Robert K. Roe, 55D Two Loch, Charleston, S.C. 29414

[21] Appl. No.: 977,245

[22] Filed: Nov. 24, 1997

[51] Int. Cl.[6] ..... A63B 69/36

[52] U.S. Cl. ..... 473/265; 473/172

[58] Field of Search ..... 473/257, 258, 473/260, 265, 172

[56] References Cited

U.S. PATENT DOCUMENTS

| | | | |
|---|---|---|---|
| 4,230,319 | 10/1980 | Lindner | 473/265 |
| 5,209,484 | 5/1993 | Randall | 473/265 |
| 5,785,604 | 7/1998 | Johnson | 473/265 |

*Primary Examiner*—George J. Marlo
*Attorney, Agent, or Firm*—B. Craig Killough

[57] ABSTRACT

A golf putting trainer, comprising:

a. a first elongated member;

b. a second elongated member which is positioned generally parallel to the first elongated member, and is spaced apart from the first elongated member;

c. a connecting member which is positioned between the first elongated member and the second elongated member and which is connected to the first elongated member near a first end of the first elongated member, and is connected to the second elongated member near a first end of the second elongated member;

d. a target which is slidably mounted to the connecting member and is in a slidable relationship with the connecting member, wherein the target is positioned between the first elongated member and the second elongated member.

13 Claims, 1 Drawing Sheet

GOLF PUTTING TRAINER

FIELD OF THE INVENTION

This invention relates to golf generally, and is more specifically directed to a training and practice aid for golf putting.

BACKGROUND OF THE INVENTION

Putting is an important part of the game of golf. Approximately half the strokes in a game of golf played at par are puts.

Good putting requires proper control of the putter. One aspect of proper control of the putter requires that the putter blade be kept straight during the stroke. A straight putter blade means that the face of the putter blade is maintained exactly perpendicular to the line between the object ball and the target, which is the golf cup. It is therefore desirable to practice keeping the putter blade straight, and not rotate the putter blade by means of the wrist as the putter is moved through the putting stroke.

Various golf training devices are shown in the prior art. Some of these devices are golf putting aids.

SUMMARY OF THE PRESENT INVENTION

The present invention is a device which assists in training the user to maintain a discipline in keeping the putter blade straight. The device is used within a relatively small and confined area, since only a few square feet are required to use the device. The device will train the user to keep the putter blade straight in attempting both long puts and short puts.

The device uses two generally parallel arms. These arms are spaced apart a distance which is slightly more than the length of the user's putter blade. Since putter blades vary in length, the device provides means for adjusting the distance between the arms.

A target is present at, or near, one end of the arms. The target is positioned between the arms. The larger target has a smaller target, which may be a void through which a golf ball can pass.

A golf ball is positioned near the end of the arms which is opposite the target. The object is to strike the ball through the void, which is generally centered between the arms. Achievement of this object requires striking the golf ball on a straight line, meaning that the club face must be straight, and perpendicular to the desired line of travel of the ball to the void.

The arms assist in producing a smooth, straight swing, since the putter blade will strike one or both of the arms, unless it is moved precisely between the arms. At the same time, if the putter blade is rotated by means of the wrists, the ball will not pass through the void.

DETAILED DESCRIPTION OF THE DRAWINGS

DETAIL OF THE PREFERRED EMBODIMENT

Figure 1:
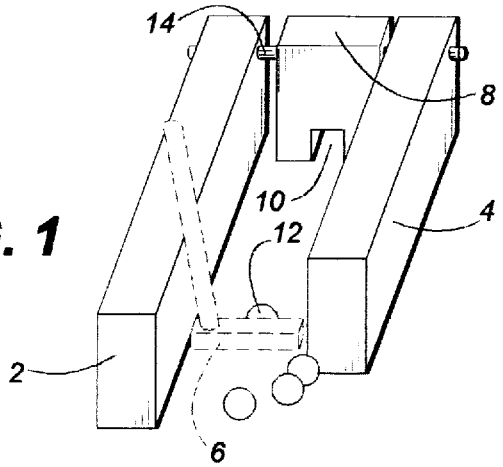
FIG. 1 is a perspective view of the golf putting trainer.
Figure 2:
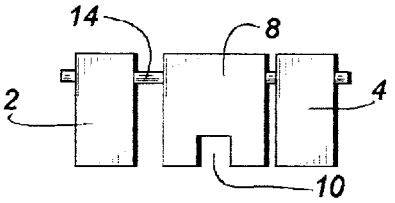
FIG. 2 is a front elevation of the golf putting trainer.
Figure 3:
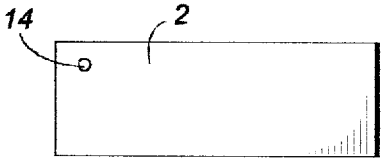
FIG. 3 is a right side elevation of the golf putting trainer.
Figure 4:
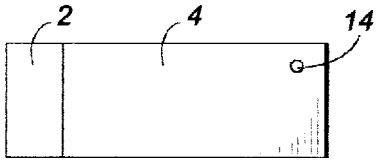
FIG. 4 is a left side elevation of the golf putting trainer.
Figure 5:
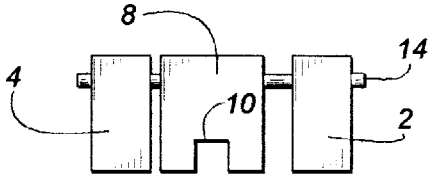
FIG. 5 is a back elevation of the golf putting trainer.
Figure 6:
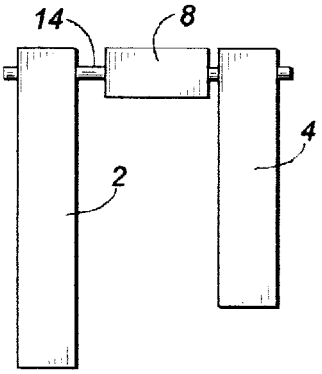
FIG. 6 is a top plan view of the golf putting trainer.
Figure 7:
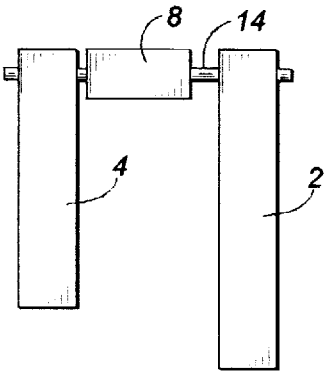
FIG. 7 is a bottom plan view of the golf putting trainer.

Referring now to the drawings, the device has a first elongated member which forms a first arm 2, and a second elongated member which forms a second arm 4. The arms are positioned so that they are substantially parallel to each other, and are spaced apart a sufficient distance to allow a putter 6 to be moved between the arms by a normal putting stroke.

A target 8 is positioned between the arms, near an end of each of the arms as shown in the drawing figures. The target extends upwardly from the surface on which the target and the device rests. A smaller target is present within the target, with the smaller target 10 preferred to be hole or void which is of sufficient size to allow a golf ball 12 to pass through the hole. The hole 10 is not much larger than necessary to allow a golf ball to pass through, and in no case, is the hole larger than the diameter of a standard golf putting cup.

Adjustment means is provided to allow the arms to be positioned, as required, relative to each other. Since putters have blades of different lengths, it is necessary to adjust the distance between the arms according to the length of the putter. The distance between the arms should not be substantially greater than the length of the putter blade so that the user learns to control the stroke of the putter through the arms, without contacting the arms, thereby maintaining a very consistent and disciplined path of travel through the arms.

As shown, the target is positioned between the arms. A pin, axle or dowel 14 connects the target and the arms. One, or both, of the arms may be repositioned along the length of the dowel to adjust the spacing between the arms. The target may be repositioned along the dowel, and relative to the arms.

To use the device, a golf ball is positioned between the two arms and near the opening formed by the arms, which is opposite the target. Generally, the target is centered between the arms, and the golf ball is also centered. However, the position of the target and the golf ball may be adjusted, so that a straight swing will result in the ball passing through the void to the target. Other means which would allow adjustment of the arms and the target relative to each other could be used.

After the ball is positioned between the arms, the user addresses the ball by stroking the ball 12 with the blade of the putter 6. The ball is positioned between the arms, and the travel of the putter head is between the arms. The user endeavors to avoid striking the arms with the putter, thereby training the user to control the stroke of the putter through a constant line. As the putter blade strikes the ball, if the putter blade is straight and perpendicular to the line between the ball and the void (and the rolling surface is level), the ball will pass through the void 10. The training device requires the putter to be moved through a stroke which is straight and on line, with the putter blade perpendicular to the required line of travel of the ball.

What is claimed is:

1. A golf putting trainer, comprising:

a. a first elongated member;

b. a second elongated member which is positioned generally parallel to said first elongated member, and is spaced apart from said first elongated member;

c. a connecting member which is positioned between said first elongated member and said second elongated member and which is connected to said first elongated member near a first end of said first elongated member, and is connected to said second elongated member near a first end of said second elongated member;

d. a target which is slidably mounted to said connecting member and is in a slidable relationship with said connecting member, wherein said target is positioned between said first elongated member and said second elongated member.

2. A golf putting trainer as described in claim 1, wherein said first elongated member extends beyond said second elongated member at an end of said first elongated member which is opposite said first end of said first elongated member.

3. A golf putting trainer as described in claim 1, wherein said first elongated member is slidably mounted to said connecting member and is in a slidable relationship with said connecting member.

4. A golf putting trainer as described in claim 3, wherein said second elongated member is slidably mounted to said connecting member and is in a slidable relationship with said connecting member.

5. A golf putting trainer, comprising:

a. a first elongated member;

b. a second elongated member which is positioned generally parallel to said first elongated member, and is spaced apart from said first elongated member;

c. a target which is slidably positioned between said first elongated member and said second elongated member near a first end of said first elongated member, and near a first end of said second elongated member, and wherein an opening is formed between said first elongated member and said second elongated member at an end thereof which is opposite said first end of said first elongated member, and no barrier is present between said first elongated member and said second elongated member at said end thereof which is opposite said first end of said first elongated member.

6. A golf putting trainer as described in claim 5, wherein said first elongated member extends beyond said second elongated member at said end of thereof which is opposite said first end of said first elongated member.

7. A golf putting trainer as described in claim 5, wherein said first elongated member is slidable relative to said second elongated member.

8. A golf putting trainer as described in claim 1, wherein said second elongated member is slidable relative to said first elongated member.

9. A golf putting trainer, comprising:

a. a first elongated member;

b. a second elongated member which is positioned generally parallel to said first elongated member, and is spaced apart from said first elongated member;

c. a connecting member which is connected to said first elongated member near a first end of said first elongated member, and is connected to said second elongated member near a first end of said second elongated member;

d. a target which is mounted to said connecting member, wherein said target is slidable relative to said first elongated member, and said target is positioned between said first elongated member and said second elongated member, and wherein an opening is formed between said first elongated member and said second elongated member at an end thereof which is opposite said first end of said first elongated member and no barrier is present between said first elongated member and said second elongated member at said end thereof which is opposite said first end of said first elongated member.

10. A golf putting trainer as described in claim 9, wherein said first elongated member extends beyond said second elongated member at an end of said first elongated member which is opposite said first end of said first elongated member.

11. A golf putting trainer as described in claim 9, wherein said first elongated member is slidably mounted to said connecting member and is in a slidable relationship with said connecting member.

12. A golf putting trainer as described in claim 11, wherein said second elongated member is slidably mounted to said connecting member and is in a slidable relationship with said connecting member.

13. A golf putting trainer as described in claim 9, wherein said target is slidably mounted to said connecting member and is in a slidable relationship with said connecting member.

* * * * *